United States Patent [19]

Pulsifer et al.

[11] Patent Number: 4,757,318

[45] Date of Patent: Jul. 12, 1988

[54] PHASED ARRAY ANTENNA FEED

[75] Inventors: Paul I. Pulsifer, Kanata; William D. Cornish, Nepean; Larry J. Conway, Stittsville, all of Canada

[73] Assignee: Her Majesty the Queen in right of Canada, as represented by the Minister of National Defence, Ottawa, Canada

[21] Appl. No.: 924,781

[22] Filed: Oct. 30, 1986

[30] Foreign Application Priority Data

Dec. 11, 1985 [CA] Canada ..... 497406

[51] Int. Cl.[4] ..... H01Q 3/22; H01Q 3/00

[52] U.S. Cl. ..... 342/375; 342/377

[58] Field of Search ..... 342/368, 371, 372, 373, 342/374, 375, 377, 81, 157, 757, 195; 333/138, 139, 161, 164; 455/276, 277

[56] References Cited

U.S. PATENT DOCUMENTS 3,882,431 5/1975 Hopwood et al. ..... 333/139

4,652,883 3/1987 Andricos ..... 333/139

*Primary Examiner*—Theodore M. Blum

*Assistant Examiner*—Gregory C. Issing

*Attorney, Agent, or Firm*—Stevens, Davis, Miller & Mosher

[57] ABSTRACT

An RF signal receiving/transmitting apparatus for use with a phased array antenna having a plurality of antenna elements comprises a plurality of signal processing circuits, each circuit being connected to and associated with one of the antenna elements and including a signal distributing/combining device connected to its associated element, a plurality of sampling gates for spatially sampling a distributed signal or applying analog samples to the distributing/combining device, and analog-to-digital or digital-to-analog converters connected to an analyzer for analyzing/generating a plurality of digital samples which are received or to be transmitted by the antenna elements.

17 Claims, 2 Drawing Sheets

PHASED ARRAY ANTENNA FEED

The present invention relates to an electronically steered phased array antenna for use in radar or receivers.

BACKGROUND OF THE INVENTION

As is well known, a phased array is a group of simple radiating antennas, hereinafter referred to as elements, arranged over an area called an aperture. A beam or beams is formed by superposition of the radiation emanating from all of the elements and the direction of the beam can be adjusted by varying the relative phase of the signal applied to each element or by varying the frequency of an oscillator. Because the signals at each element must be related in phase, they have heretofore been derived from a reference oscillator. The signal from the oscillator is fed to the elements of the array through various combinations of amplifiers and phase shifters, of which there are many different configurations.

The primary limitation in present phased array systems is the complexity and cost of the feed structure. Maintaining the correct phase of each element is especially difficult since phase tracking must be maintained from the reference oscillator through a combining network and phase shifters. The phase shifters are not easily made, particularly if fine adjustments over 360° are required. In addition, the bandwidths of the phase shifters are relatively narrow. The use of digital phase shifters implies a quantization of the phase. If the quantization is coarse, the side lobe levels of the beam are increased and it is generally not presently feasible to produce phased array systems with very low side lobe levels because of the cost and complexity of making digital phase shifters which provide fine phase control.

SUMMARY OF THE INVENTION

The present invention replaces the conventional radio frequency (RF) feed structure, including the reference oscillator, with a sampling arrangement which allows direct digital generation of the signal to be transmitted at each element with the desired amplitude and phase. The apparatus may be readily adapted to function as a receiver or transmitter or both.

In accordance with one aspect of the present invention, there is provided an apparatus for exciting a phased array antenna having a plurality of antenna elements. The apparatus comprises means for producing a plurality of series of digital words, each series of digital words being representative of a signal to be transmitted by one of the elements, each digital word of each series being representative of a predetermined value of a signal to be transmitted from the elements. A plurality of signal processing means connect the producing means and one of the antenna elements. Each signal processing means includes a plurality of digital-to-analog converters each of which is adapted to receive in predetermined sequence the digital words of one of the series of digital words and convert received digital words to corresponding analog signals. The apparatus further includes means for combining the analog signals output by the plurality of digital-to-analog converters to produce a combined signal and feed the combined signal to the one of the antenna elements.

In accordance with another aspect of the invention, there is provided a receiver for use with a phased array antenna having a plurality of antenna elements. The receiver comprises a plurality of signal processing means, each of which is connected to and associated with one of the antenna elements and includes means for distributing a signal received at the one of the antenna elements, means for spatially sampling the distributed signal for producing a plurality of analog samples, and means for digitizing the analog samples to produce a plurality of digital samples. The receiver further includes means for analyzing the plurality of digital samples from each of the signal processing means.

BRIEF DESCRIPTION OF THE INVENTION

These and other features of the invention will become more apparent from the following description in which reference is made to the appended drawings, wherein.

DETAILED DESCRIPTION

Figure 1:
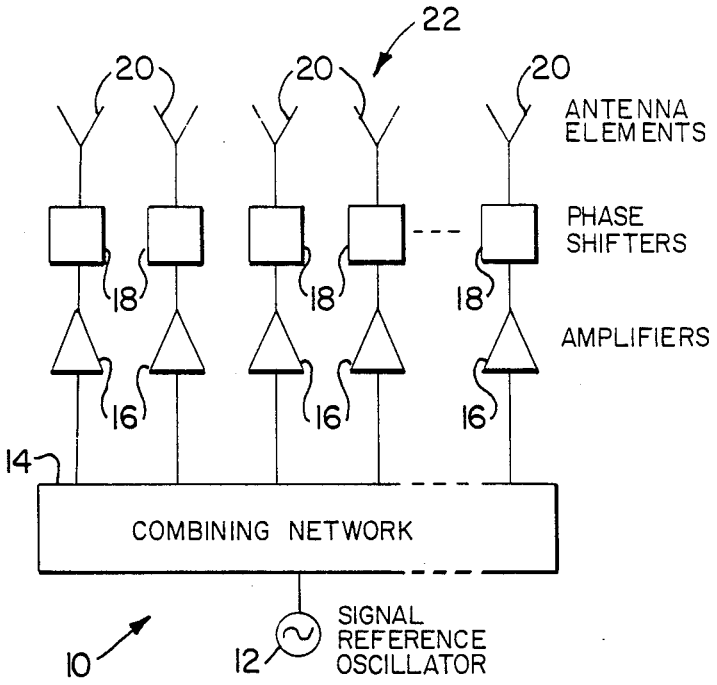
FIG. 1 PRIOR ART
FIG. 1 is a block diagram representation of a prior art arrangement for exciting a phased array antenna.

FIG. 1 illustrates a conventional phased array feed circuit 10 including a reference oscillator 12, a combining network 14 feeding a plurality of amplifiers 16, each of which feeds one of plurality of phase shifters 18 each of which, in turn, excites an antenna element 20 of an antenna 22. There are many combining network/phase shifter configurations which are well known to those skilled in this art and thus need not be described further detail.

As mentioned previously, the primary limitation in present phased array systems is the complexity and cost of the feed structure. Maintaining the correct phase of each antenna element is especially difficult since phase tracking must be maintained from the reference oscillator through the combining network and phase shifters. The phase shifters are not easily made, particularly if fine adjustments are required over 360°, and their bandwidths are relatively narrow. The use of digital phase shifters involves quantization of the phase and, if the quantization resulting from digital phase shifters is coarse, the side lobe levels of the beam are increased. Heretofore, it has not been feasible to produce phased array systems which produce very low side lobes because of the cost and complexity of making digital phase shifters which provide fine phase control.

Figure 2:
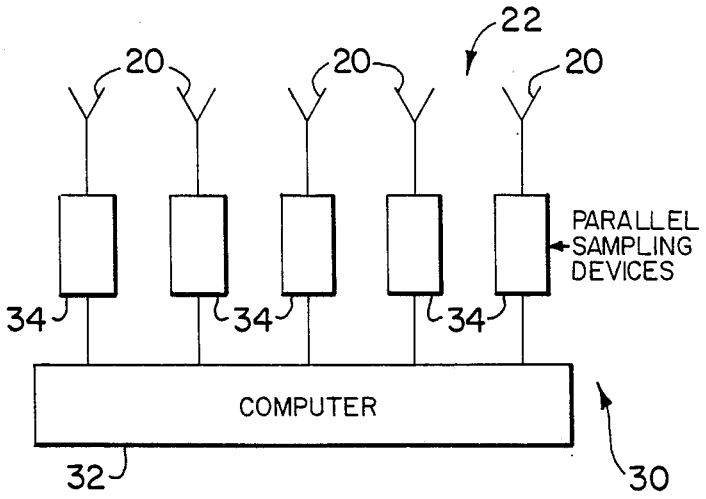
FIG. 2 is a block diagram representation of the phased array antenna feed of the present invention.
Figure 3:
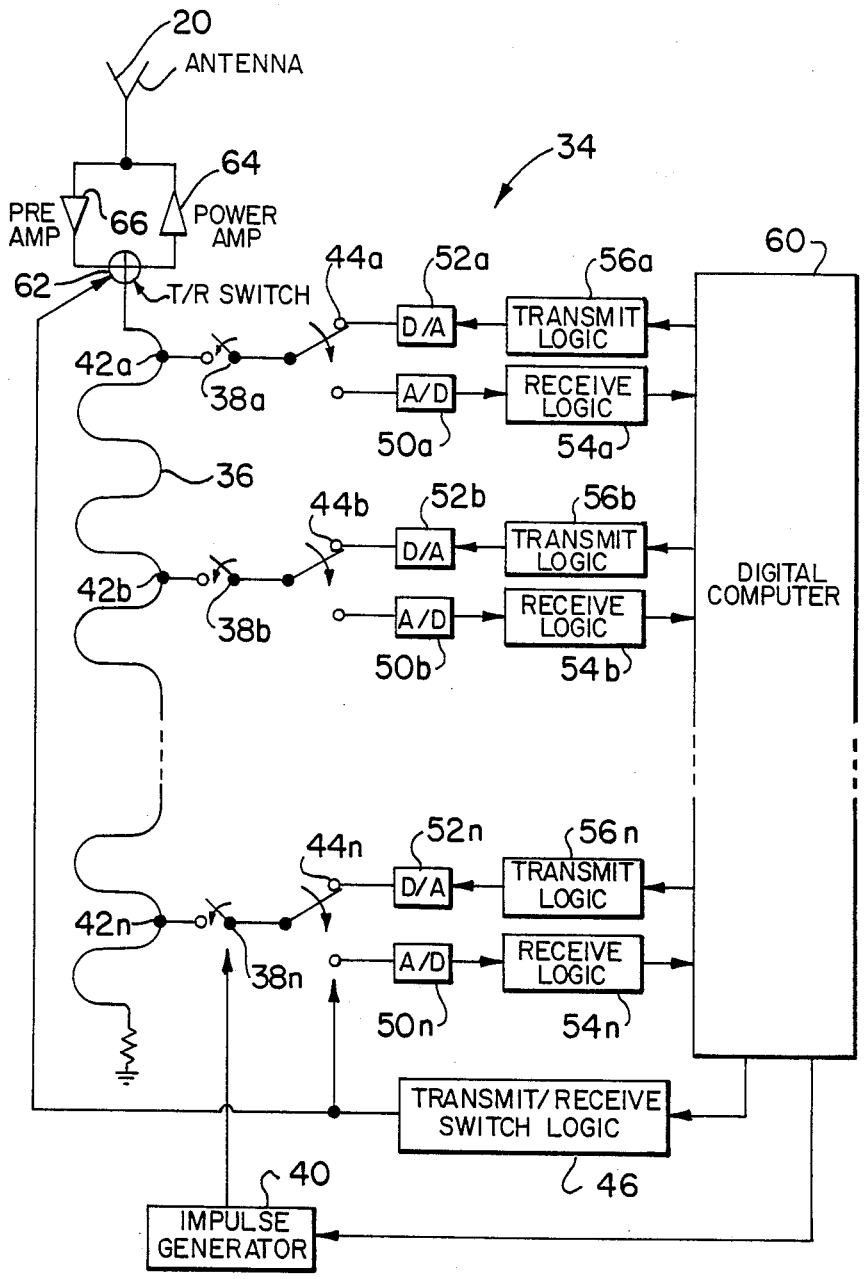
FIG. 3 is block diagram representation of a phased array antenna element excitation/sampling device of the present invention.

FIG. 2 illustrates the basic concept of the present invention, generally designated by reference numeral 30, in which each antenna element 20 of a phased array antenna 22 is driven by a sampling arrangement 34 controlled a digital signal processor controller 32. FIG. 3 illustrates one of the sampling arrangements 34. As explained hereinbelow, the system is capable of transmitting one or more signals or of receiving one or more signals.

Each sampling arrangement 34 is comprised of a meander delay line means 36 electrically connected to an antenna element and a plurality of sampling gate means **38*a* to 38*n* controlled by an IMPULSE GENERATOR 40. Gate means 38*a* to 38*n* have one terminal electrically connected to a predetermined points 42*a* to 42*n* on the delay line. The system further includes an equal number of selector switches 44*a* to 44*n*, controlled by a TRANSMIT/RECEIVE SWITCH LOGIC means generally designated by reference numeral 46, and an equal number of pairs of analog-to-digital converter means 50***a* to 50*n* and digital-to-analog converter means 52*a* to 52*n*. RECEIVE LOGIC means 54*a* to 54*n* are respectively associated with analog-to-digital converters 50*a* to 50*n* while TRANSMIT LOGIC means 56*a* to 56*n* are respectively associated with digital-to-analog converters 52*a* to 52*n*. The RECEIVE LOGIC and TRANSMIT LOGIC means communicate with a processor 60, as shown.

It will be understood that each analog-to-digital converter is adapted to convert the voltage level output by its associated gate means to a digital word representative of the value of the signal received by its associated element and transmit the digital word to the RECEIVE LOGIC means. Similarly, the digital-to-analog converter means is adapted to convert a digital word received from its associated TRANSMIT LOGIC means to an analog signal and transmit the analog signal to its associated gate means.

The sampling means further includes a second selector switch 62, controlled by TRANSMIT/RECEIVE SWITCH LOGIC means 46, a power amplifier 64 for amplifying a signal to be transmitted by the antenna element and a preamplifier 66 for amplifying a signal or beam received by the antenna element.

In the case of a transmitter, the microprocessor generates a waveform or waveforms, which are capable of being described mathematically, to be transmitted by the phased array. The microprocessor computes the values of the waveform or waveforms for predetermined timed intervals and produces digital words or bit streams representative of such values. The digitized waveform values may be stored either in a mass storage memory (internal to the processor) and then transferred to a number of fast RAM's or transferred directly to the fast RAM's. Alternatively, predetermined waveform values may be stored in lookup tables in an appropriate memory. The computer is also used to analyze data received via the phased array. The procedures for generating data representing the waveform(s) to be transmitted or analyzing data representing a received waveform(s) are well known to those skilled in the art and need not be described in further detail.

When transmitting a waveform(s), the computer applies appropriate signals to the TRANSMIT LOGIC means 56*a* to 56*n* each of which, in turn, feeds a digital word representative of a value of a signal to be transmitted by its associated antenna element to its associated digital-to-analog converter. Simultaneously, the computer activates the TRANSMIT/RECEIVE SWITCH LOGIC means 46 which triggers selector switches 38*a* to 38*n* to simultaneously connect the digital-to-analog converters to their associated sampling gates and the second selector switch 62 to power amplifier 64. Once the digital-to-analog converters have settled, the computer initiates a signal which triggers the impulse generator which in turn simultaneously activates all of the sampling gates, thus transmitting the analog output of the digital-to-analog converters to the meander delay line. The meander delay line combines all of the analog signals in a time series manner to thereby construct the signal which is to be transmitted by the antenna element 20 to which the delay line is connected. The constructed signal propagates in both directions along the meander delay line where it is terminated at one end through a termination resistor and is transmitted at the other end to power amplifier 64 and then to antenna element 22.

In the receive mode, the computer issues a command which triggers TRANSMIT/RECEIVE SWITCH LOGIC means 46 which in turn triggers the first set of selector switches 44*a* to 44*n* to connect the analog-to-digital converter inputs to their respective sampling gates and the second selector switch 62 to preamplifier 66. Thus, any signal received by the antenna element is amplified by the preamplifier and transmitted to the meander delay line. At a predetermined time, the computer initiates a command which triggers impulse generator 40 to simultaneously activate all of the sampling gates. Their respective signals are thus transmitted to their associated analog-to-digital converters where they are digitized and then transmitted to the RECEIVE LOGIC means. The processor accesses the data from the RECEIVE LOGIC means to determine the direction of arrival of the incoming signal or beam. If only one beam was received, the direction of arrival would be known. However, if multiple beams were received simultaneously, the direction of arrival would be determined by examining the signals appearing at the output of the analog-to-digital converters. Computer algorithms would determine the direction of arrival, either through computation or by comparison with a lookup table. Such algorithms are well known to those skilled in the art and form no part of this invention and, accordingly, will not be described further.

Thus, it will be seen that all signal formation is accomplished with digital electronics. There are no microwave, adjustable components such as phase shifters or oscillators. The amplitude and phase of the signal at each antenna element is obtained directly from digital circuitry. Conversely, when a signal is received by a phased array, it is decoded directly with digital electronics.

The embodiments of the invention in which an exclusive property or privilege is claimed are defined as follows:

1. An apparatus for exciting a phased array antenna having a plurality of antenna elements each being adapted to transmit a predetermined signal, said apparatus comprising:

means for producing a plurality of series of digital words, each series of digital words being representative of a signal to be transmitted by one of said elements;

a plurality of signal processing means, each said signal processing means connecting said producing means and one of said antenna elements, each said signal processing means comprising:

a plurality of digital-to-analog converter means, each said converter means being adapted to receive in predetermined sequence the digital words of one of said series of digital words and convert received digital words to corresponding analog signals; and means for combining analog signals from said plurality of digital-to-analog converters means to produce a combined signal and for feeding said combined signal to said one of said antenna elements.

2. An apparatus as defined in claim 1, each said signal processing means including sampling means for connecting said plurality of converter means to said combining means at predetermined timed intervals.

3. An apparatus as defined in claim 2, further including controller means for activating said sampling means.

4. An apparatus as defined in claim 3, said controller means being responsive to a trigger signal from said producing means.

5. An apparatus as defined in claim 2, 3 or 4, said sampling means including a sampling gate associated with each said converter means.

6. An apparatus as defined in claim 2, said combining means including a delay line means, said sampling means being connected to predetermined, spaced points along said delay line.

7. An apparatus as defined in claim 1, said combining means including a power amplifier for amplifying said combined signal prior to feeding said signal to said one of said antenna elements.

8. An apparatus for exciting a phased array antenna having a plurality of antenna elements each being adapted to transmit a predetermined signal, said apparatus comprising:

means for producing a plurality of series of digital words, each series of digital words being representative of a signal to be transmitted by one of said elements;

a plurality of signal processing means, each said signal processing means connecting said producing means and one of said antenna elements, each said signal processing means comprising:

a plurality of digital-to-analog converter means, each said converter means being adapted to receive in predetermined sequence the digital words of one of said series of digital words and convert received digital words to corresponding analog signals; and a plurality of sampling gates, each of said sampling gates being associated with one of said digital-to-analog converter means;

delay line means, each said sampling gate being spatially connected to said delay line means, said delay line means being adapted to combine analog signals from said plurality of sampling gates to produce a combined signal;

amplifier means for amplifying said combined signal and feeding said amplified combined signal to said one of said antenna elements; and controller means responsive to said producing means for activating said sampling gate means.

9. A receiver for use with a phased array antenna having a plurality of antenna elements, said receiver comprising:

a plurality of signal processing means, each said signal processing means being connected to and associated with one of said antenna elements and including:

means for distributing a signal received at said one of said antenna elements;

means for spatially sampling said distributed signal and producing a plurality of analog samples; and means for digitizing said analog samples to produce a plurality of digital samples; and means for analyzing said plurality of digital samples from each of said signal processing means.

10. A receiver as defined in claim 9, each said signal processing means including sampling means for connecting said digitizing means to said distributing means at predetermined timed intervals.

11. A receiver as defined in claim 10, further including controller means for activating said sampling means.

12. A receiver as defined in claim 9 or 10, said sampling means being a sampling gate associated with each said digitizing means.

13. A receiver as defined in claim 9 or 10, said digitizing means being a plurality of analog-to-digital converters.

14. A receiver as defined in claim 9 or 10, said distributing means including a delay line means, said sampling means being connected to predetermined, spaced points along said delay line.

15. A receiver as defined in claim 9, said signal processing means including a preamplifier for amplifying a signal before distributing said signal.

16. A receiver for use with a phased array antenna having a plurality of antenna elements, said receiver comprising:

a plurality of signal processing means, each said signal processing means being connected to and associated with one of said antenna elements and including:

a preamplifier for amplifying a signal received at its associated antenna element and producing an amplified signal;

delay line means for distributing said amplified signal;

a plurality of sampling sampling gates for sampling said distributed signal and producing a plurality of analog samples; and a plurality of analog-to-digital converters, each of said converters being connected to and associated with one of said sampling gates for digitizing analog samples therefrom and producing a plurality of digital samples;

controller means for simultaneously activating said sampling means; and means for analyzing said plurality of digital samples from each of said signal processing means.

17. A receiver/transmitter for use with a phased array antenna having a plurality of antenna elements, comprising:

means generating digital values of signals to be transmitted from each said element and for analyzing signals received therefrom;

a plurality of signal processing means, each said signal processing means connecting said generating means and one of said antenna elements, each said signal processing means including:

delay line means connected to one of said antenna elements;

a plurality of sampling gates spatially connected to said delay line means;

a plurality of analog-to-digital converters, each of said converters being associated with one of said sampling gates for digitizing analog sample therefrom;

a plurality of digital-to-analog converter means, each said converter means being associated with one of said sampling gates and being adapted to convert digital values received from said generating means to corresponding analog signals;

first controller means responsive to said generating means for connecting each said sampling gate to one of its associated converters; and second controller means responsive to said generating means for simultaneously activating said sampling gates.

* * * * *